US006425842B1

(12) United States Patent
Stern et al.

(10) Patent No.: US 6,425,842 B1
(45) Date of Patent: Jul. 30, 2002

(54) CHILD ACTIVITY DEVICE

(75) Inventors: Carl M. Stern, Pennington, NJ (US); Andrew M. Weiman, Newtown, PA (US); Timothy J. Snyder, West Seneca; Brian S. Kelly, Orchard Park, both of NY (US)

(73) Assignee: Mattel, Inc., El Segundo, CA (US)

( * ) Notice: Subject to any disclaimer, the term of this patent is extended or adjusted under 35 U.S.C. 154(b) by 30 days.

(21) Appl. No.: 09/654,917

(22) Filed: Sep. 5, 2000

Related U.S. Application Data

(63) Continuation-in-part of application No. 09/653,008, filed on Aug. 31, 2000.

(51) Int. Cl.[7] ..... A63B 9/00; A63B 17/00
(52) U.S. Cl. ..... 482/35; 482/77; 482/66
(58) Field of Search ..... 482/3, 5, 77, 66

(56) References Cited

U.S. PATENT DOCUMENTS

| | | | | |
|---|---|---|---|---|
| 196,730 | A | 10/1877 | Wick | |
| 432,378 | A | 7/1890 | Davidson et al. | |
| RE11,140 | E | 1/1891 | Burkholder | |
| 1,688,922 | A | 10/1928 | Drinosky, Jr. | |
| 2,198,813 | A | 4/1940 | Hall | 155/22 |
| 2,665,742 | A | 1/1954 | Starsky | 155/24 |
| 2,812,012 | A | 11/1957 | Hansburg | 155/123 |
| 4,359,242 | A | 11/1982 | Gerken et al. | 297/5 |
| 4,553,786 | A | 11/1985 | Lockett, III et al. | 297/440 |
| 4,743,008 | A | 5/1988 | Fermaglich et al. | 272/69 |
| 5,187,826 | A | 2/1993 | Mariol | 5/655 |
| 5,269,591 | A | 12/1993 | Miga, Jr. et al. | 297/452.13 |
| 5,407,246 | A | 4/1995 | Meeker et al. | 297/137 |
| 5,433,682 | A | 7/1995 | Fermaglich et al. | 482/66 |
| 5,451,093 | A | 9/1995 | Petrie et al. | 297/137 |
| 5,480,210 | A | 1/1996 | Lehenbauer et al. | 297/137 |
| 5,518,475 | A | 5/1996 | Garland | 482/68 |
| D378,554 | S | 3/1997 | Meeker et al. | D6/511 |
| 5,645,489 | A | 7/1997 | Laiche et al. | 472/103 |
| 5,688,211 | A | * 11/1997 | Myers | 482/66 |
| 5,690,383 | A | 11/1997 | Meeker et al. | 297/274 |
| 5,700,201 | A | 12/1997 | Bellows et al. | 472/103 |
| D395,467 | S | 6/1998 | Bellows | D21/66 |
| 5,887,945 | A | 3/1999 | Sedlack | 297/296 |
| 6,062,588 | A | 5/2000 | Cheng | 280/642 |
| 6,062,589 | A | 5/2000 | Cheng | 280/647 |
| 6,067,676 | A | 5/2000 | Carnahan et al. | 5/99.1 |

FOREIGN PATENT DOCUMENTS

| | | |
|---|---|---|
| CH | 0270503 | 12/1950 |
| GB | 463827 | 4/1937 |

* cited by examiner

*Primary Examiner*—Michael A. Brown
*Assistant Examiner*—Lori Baker Amerson
(74) *Attorney, Agent, or Firm*—Morgan, Lewis & Bockius, LLP

(57) ABSTRACT

A child activity device for entertaining and promoting activity in a child is disclosed. The child activity device is configurable between a use and storage position and may also include a frame providing bouncing motion for a child. The activity device includes a support frame extending vertically upwards from a lower end proximate to a support surface and terminating at an upper end, a supporting portion, and may further include a seat, coupled to the supporting portion, that is rotatable about a first axis relative to the support frame to allow a child placed in the seat to rotate about the first axis. A coupling assembly is also disclosed. The coupling assembly secures the supporting portion to the support frame upper end and permits rotation of the supporting portion about a second axis for configuring the seat and supporting portion in a storage position. An activity device with foldable support legs is also disclosed. The support legs to base structure connection may further include a mechanism for providing bouncing motion for entertaining the child.

25 Claims, 11 Drawing Sheets

CHILD ACTIVITY DEVICE

This application claims priority to the U.S. patent application Ser. No. 09/653,008 filed on Aug. 31, 2000, pending, which is hereby incorporated by reference. The invention relates broadly to a child supporting activity device and more specifically, the invention relates to a child supporting activity device for entertaining and promoting activity in a young child.

BACKGROUND OF THE INVENTION

There are many types of child activity and/or entertainment devices available today. Such devices include, e.g., bouncer seats, exercisers and jumpers, each of which being designed for providing a comfortable and secure environment for the child, as well as a source for entertaining or promoting activity in the child. Bouncer seats are referred to as such because the child has the ability to bounce or jump when sitting in the seat.

U.S. Pat. No. 5,407,246 to Meeker discloses a seat, referred to as a child exerciser/rocker, that includes an upper tray area defining a circular opening for receiving and rotatably supporting a seat. The tray and seat are suspended at each of three locations by a spring extending from a post that is supported at its lower end by a tower extending upwards from a base structure. One notable drawback in Meeker's exerciser/rocker seat, and other child seats of this design, is that the seats are rather bulky. A seat and activity area that provides a child with freedom to move or spin around as well as providing a variety entertainment activities, such as Meeker, brings about an end product that is rather bulky, not easily stored and difficult to transport.

One approach for providing a collapsible seat is described in U.S. Pat. No. 5,688,211 to Myers. Myers describes a child exerciser device including a seat, tray and leg assembly detachable from a base member. Myers's child exerciser includes a detachable assembly and a pivot connection between the leg and tray so that the child exerciser may be collapsed for storage and/or transport. The collapsed configuration is achieved by removing the legs from the base member, rotating the legs under the tray and then placing the tray, seat and legs inside the base member. There are several aspects of the Myers exerciser which are undesirable, some of which include the limited activity area provided for the child, the requirement that a user must physically separate the base member from the legs, seat and tray in order to collapse the exerciser, and the approach for collapsing the device does not significantly reduce the space occupied by the exerciser for storage purposes, nor provide for an easily transportable device.

In view of the above and other related drawbacks and limitations identified in the known child activity devices, there is a need for a child's activity device that can be easily collapsed into a stowed configuration without sacrificing entertainment value to the child; providing freedom of movement and a relatively large activity area for entertaining and promoting activity; and yet is easy to convert into a non-use or stowed configuration for storage and/or transport.

SUMMARY OF THE INVENTION

The needs identified above are met, and the shortcomings of prior art child activity devices designs overcome by the child activity device of the invention. In one aspect, the invention provides a portable activity center for entertaining a child. The activity center is supported on a support surface and includes a support frame extending vertically upwards from a lower end proximate to the support surface and terminating at an upper end, and a seat supporting portion. A seat is coupled to the seat supporting portion and is able to rotate about a first axis relative to the support frame so as to allow a child placed in the seat to rotate about the first axis. A coupling assembly secures the seat supporting portion to the support frame upper end. The coupling assembly is selectable between a closed position fixing the seat supporting portion relative to the support frame and an open position permitting rotation of the seat supporting portion about a second axis perpendicular to the first axis. The portable activity center may further include a support leg extending form the support frame lower end and being selectively rotatable about a third axis, substantially parallel to the second axis for rotation between a use position and a storage position.

In another aspect of the invention, a child's bouncer includes a frame having an upper end and a lower end, and a seat coupled to the frame upper end. A left and right support leg extend outwardly from the frame lower end, each of the left and right support legs including a support surface engaging end and a frame coupling end rotationally displaceable relative to the frame. A biasing member is coupled to each of the left and right support legs and positioned so as to bias each of the left and right support legs support surface engaging ends inwardly by rotational displacement of the left and right support legs frame coupling ends relative to the frame lower end.

A further aspect of the invention provides a method for configuring a child's activity seat from a deployed position to a folded position. The child's activity seat includes a seat coupled to a tray, a base support having an upper end and a lower end and a support frame supporting the activity seat in the deployed position. When the activity seat is configured in the deployed position, a first connector fixes the tray to a base support and a second connector fixes the support frame to the base support. The method of configuring the activity seat from the deployed to folded positions includes the steps of releasing the first connector so as to permit rotational motion of the seat and tray relative to the base support, and rotating the seat and tray about a first axis so as to position the seat and tray from a generally horizontal, deployed position to a generally vertically, folded position.

Another aspect of the invention provides an activity seat for a child configurable between a use position and a storage position. The activity seat includes a frame extending vertically upwards from a lower end proximate to the support surface and terminating at an upper end. The frame lower end includes a lower surface corresponding to a support surface engaging end for the activity seat when configured in the storage position. The activity seat further includes a seat coupled to the support frame upper end, and a support member having a first end and a second end corresponding to a support surface engaging end for the activity seat when configured in the use position. A coupling assembly is provided for coupling the support member to the frame. The coupling assembly includes a first pivot for configuring the support member between a use and a storage configuration, and a biasing means for biasing the frame upwardly when the activity seat is configured in the use position.

In another aspect of the invention, there is provided a foldable activity center for entertaining a child. The activity center includes a base support and a base frame extending vertically upwards from a lower end proximate to the support surface and terminating at an upper end. The activity center also includes a supporting portion having a child's seat and an upper surface generally defining an activity area for a child placed in the seat, the upper surface defining a first plane. A coupling assembly secures the supporting portion to the base upper end. The coupling assembly is selectable between a closed position fixing the supporting portion relative to the base frame and an open position permitting rotation within a second plane of the supporting portion relative to the base frame, wherein the second plane is substantially perpendicular to the first plane.

It is a further object of the invention to provide a child's activity center that is specially adapted for being configurable between a use and storage configuration wherein the storage configuration also provides for easy transport, and yet does not detract from the desire for providing the child with freedom of movement and a relatively large activity area for entertaining and promoting activity in the child.

It is still a further object of the invention to provide a child activity device that has a novel support structure for providing bouncing activity for the child.

It is to be understood that both the foregoing general description and the following detailed description are exemplary and explanatory and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate preferred embodiments of the invention and together with the description serve to explain the principles of the invention. In the drawings.

DETAILED DESCRIPTION

Reference will now be made in detail to the presently preferred embodiments of the invention. The child activity device of the invention is preferably implemented as a child's entertainer 10, examples of which are illustrated in FIGS. 1–15.

Figure 1:
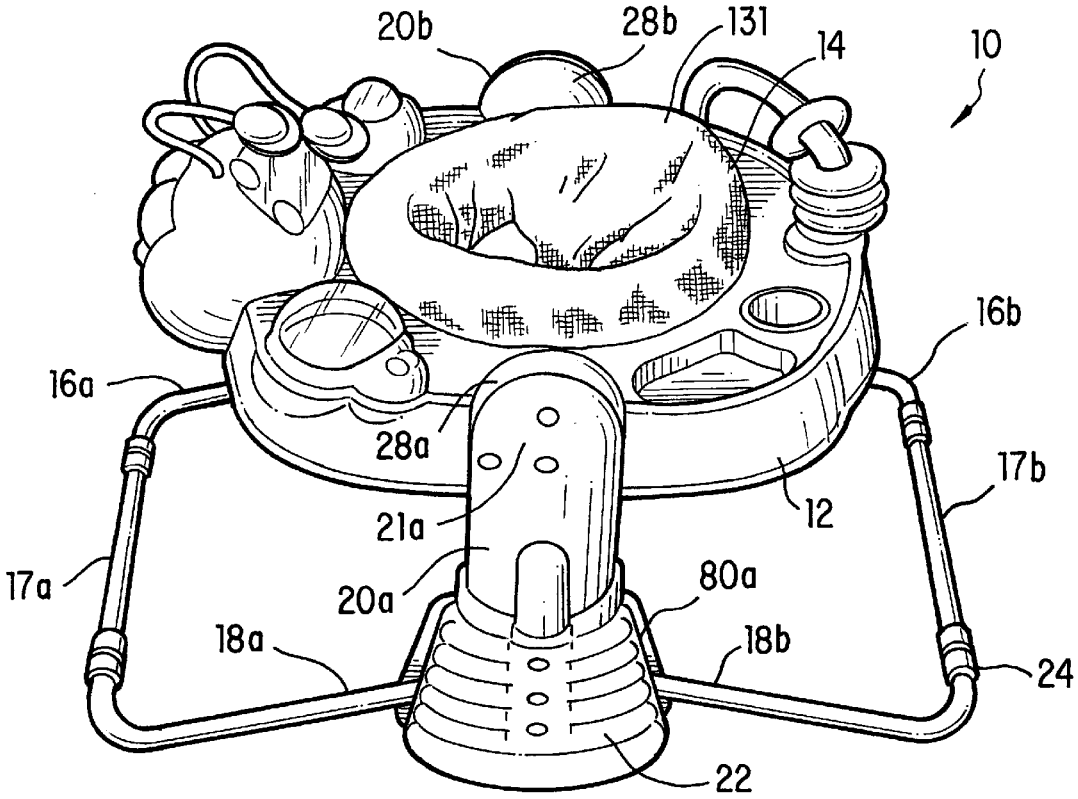
FIG. 1 is a side perspective view of a child activity device constructed in accordance with the principles of the invention.

Referring FIG. 1, entertainer 10 includes a tray 12 and seat 14 supported on front and rear support posts 20*a*, 20*b*, the lower ends of which being received in a corresponding front and rear base 80*a*, 80*b* (rear base 80*b* is hidden from view in FIG. 1), and a left and right support tube 16*a*, 16*b* connected to each of the front and rear bases 80*a*, 80*b* at front and rear tube proximal ends 18*a*, 18*b*, respectively, and providing a ground engaging support at rearwardly extending tube distal ends 17*a*, 17*b*, respectively, for entertainer 10 when configured in the use position. Tray 12 extends about the periphery of seat 14 and includes entertaining toys for entertaining and promoting activity in a child placed in seat 14.

A pair of tray connectors 28*a*, 28*b* connects tray 12 and seat 14 to an upper end 21*a* of each of front and rear posts 20*a*, 20*b*. Each of tray connectors 28*a*, 28*b* provide selective coupling of tray 12 and seat 14 to front and rear posts 20*a*, 20*b*, selectable between a fixed tray use position fixing tray 12 and seat 14 in a horizontal position, FIG. 1, a tray rotation position allowing tray 12 and seat 14 to be rotated relative to post 20 for configuring tray 12 and seat 14 between a use and storage position, and a fixed tray storage position fixing tray 12 and seat 14 relative to post 20 in a generally vertical orientation, FIG. 2.

Figure 9:
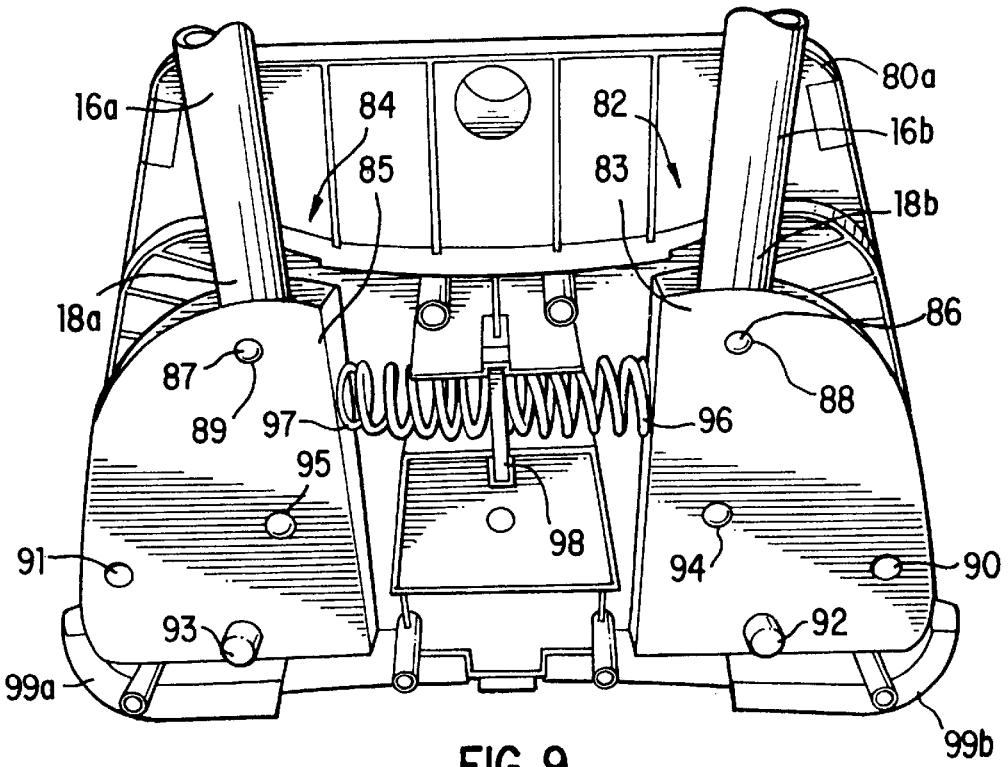
FIG. 9 illustrates a base connector assembly connecting a left and right support tube to a base of the activity device of FIG. 1.

Referring to FIG. 9, support tubes 16*a*, 16*b* are connected to front and rear bases 80*a*, 80*b* at each of their respective front and rear proximal ends 18*a*, 18*b*, by a corresponding left base connector 82 and right base connector 84 disposed at each of the front and rear bases 80*a*, 80*b*. Thus, left and right base connectors, 82, 84, are located at each of the front and rear bases 80*a*, 80*b* for connecting the left and right proximal ends 18*a*, 18*b* of support tubes 16*a*, 16*b* to bases 80*a*, 80*b*. The connecting structure associated with each of the front and rear pairs of base connectors 82, 84 permits left and right support tubes 16*a*, 16*b* to be positioned between a use or supporting position, FIGS. 1 and 11B–C, and a storage position, FIG. 3, by selecting between a fixed support tube coupling, FIG. 11B, and rotatable support tube coupling, FIG. 11A. As explained in greater detail, below, front and rear base connectors 82, 84 preferably couples tubes 16*a*, 16*b* to bases 80*a*, 80*b*, by a rotational biasing-type connector so as to provide bouncing support of entertainer 10 through tubes 16*a*, 16*b* for promoting child activity and adding entertainment value to entertainer 10. As will be appreciated, the bouncing feature may, or may not be included with the use and storage positioning feature of tubes 16*a*, 16*b* and base connectors 82, 84. It is therefore considered within the scope of invention to provide an activity device with a tube or similar connecting assembly that provides a storable support frame which may, or may not also provide a bouncing frame feature.

Figure 4:
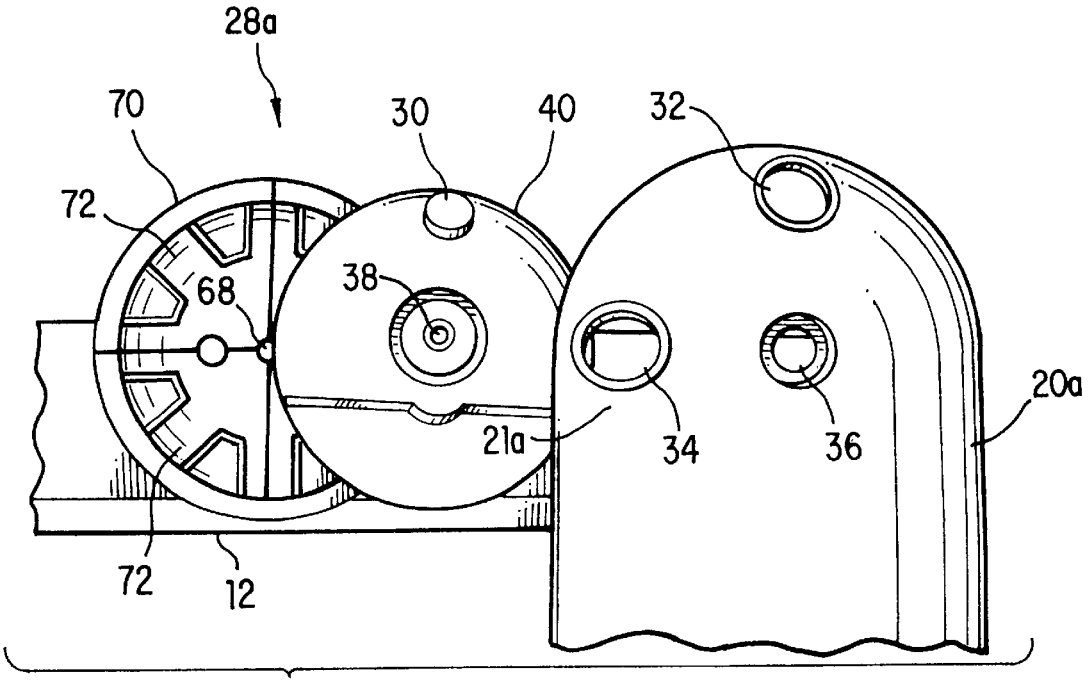
FIG. 4 is a partial exploded view of a connector assembly for connecting the tray to a support post of the activity device of FIG. 1.
Figure 5:
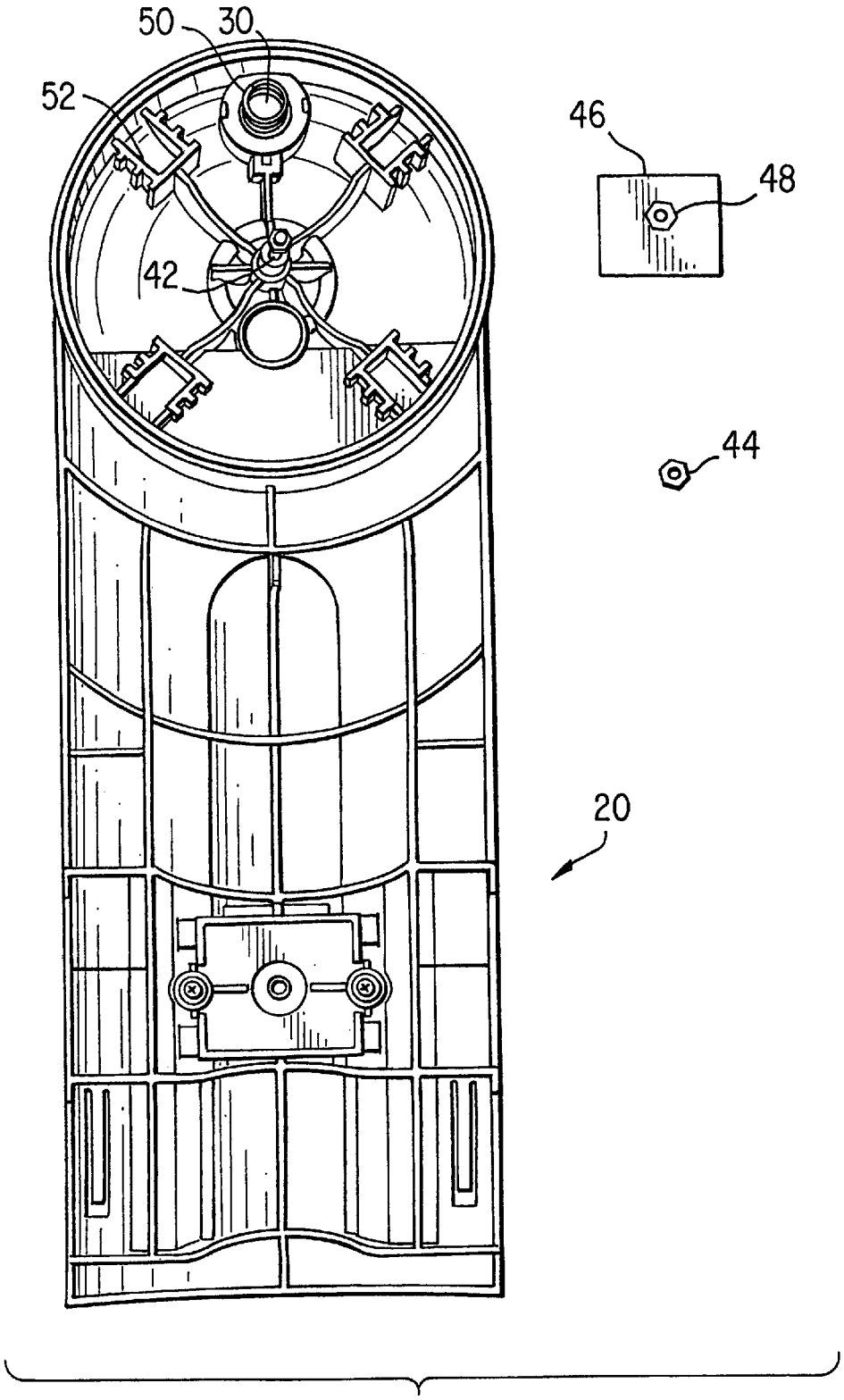
FIG. 5 is a first view of a portion of the connector assembly of FIG. 4 showing a first view of the support post and a mating housing.

Tray connector 28 will now be described in detail with reference to FIGS. 2–8. Each of the tray connectors 28*a*, 28*b* located at front and rear locations on entertainer are identical in configuration and function in a similar manner. The following discussion will therefore be limited to front tray connector 28*a*, with the understanding that the same description applies to rear tray connector 28*b*, except as noted otherwise. Tray connector 28*a* includes a circular tray housing 70 formed at the front end of tray 12, a circular mating housing 40 sized to mate with tray housing 70, a spring biased release button 30 for selecting between storage and use positions, and a circular housing formed at post upper end 21*a* sized to receive mating housing 40 and permitting relative rotational motion between mating housing 40 and post upper end 21*a* when tray connector 28*a* is configured to allow rotational motion. Referring to FIGS. 4 and 5, tray housing 70 includes ribs defining four receiving slots 72 disposed at 90 degree angular locations within tray housing 70 that are brought into mating contact with four corresponding angularly disposed teeth 52 in mating housing 40 for providing added structural integrity to the tray 14 to post connection. Preferably, tray housing 70 and mating housing 40 are formed by separate molding processes and then connected together to provide a reliable and durable interface with post upper end 21*a*, a rotatable or fixed coupling with upper end 21*a*, and to allow spring biased release button 30 to be conveniently positioned between mating housing 40 and tray housing 70. Alternatively, mating housing 40 and tray housing 70 can be integrally formed with tray 12 by providing suitably strengthened structure in the vicinity of tray connector 28*a*, as would be apparent to the skilled artisan. Holes 36, 38 and 68 are formed in post upper end 21*a*, mating housing 40 and tray housing 70, respectively, for receiving a connecting bolt 42 for rotatably coupling upper end 21a to mating housing 40 and tray housing 70. Connecting bolt 42 includes a threaded end for securing bolt 42 using a threaded nut 44 that is received within a recess 48 of a bearing plate 46.

Figure 6:
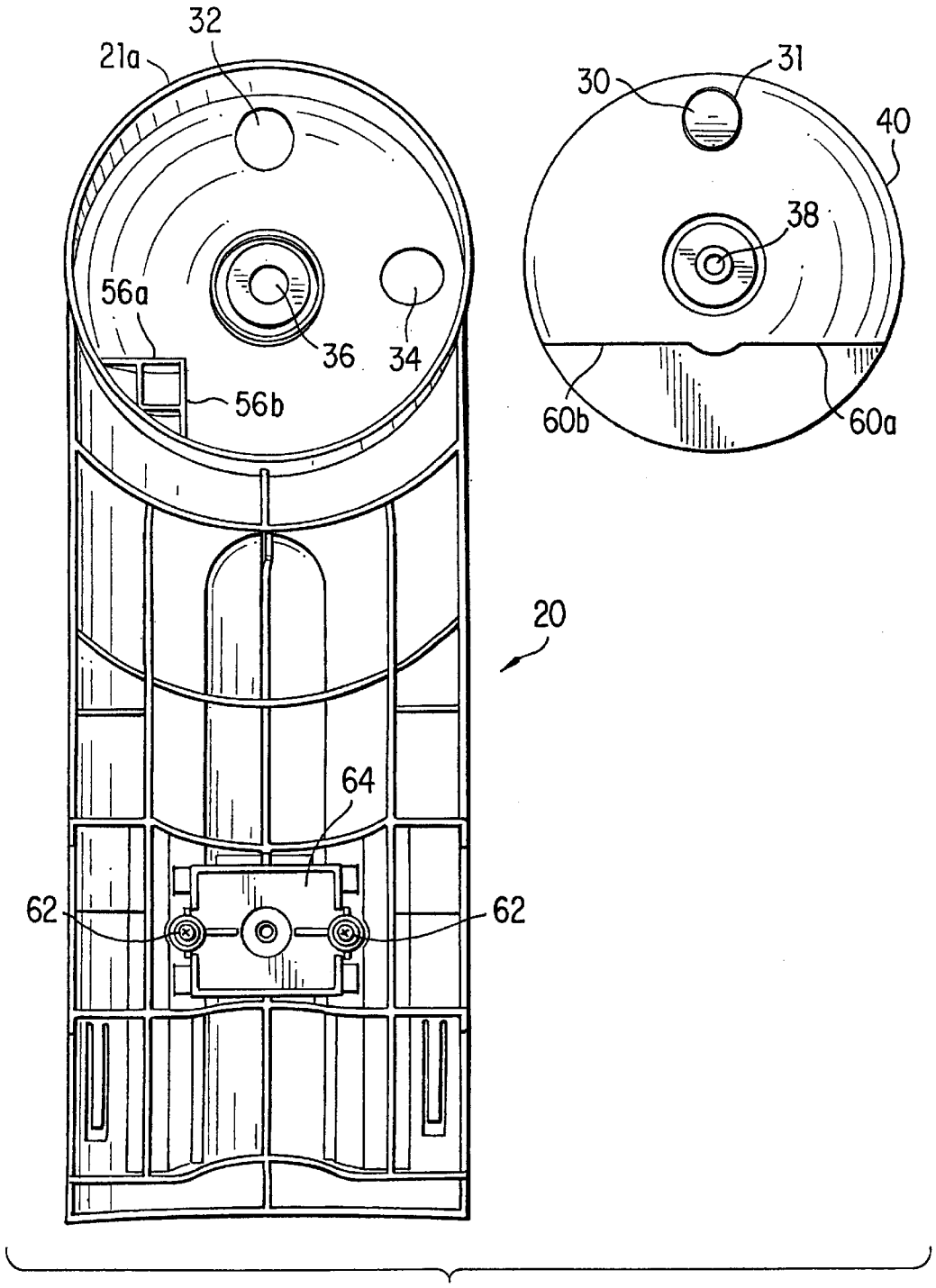
FIG. 6 is a second view of a portion of the connector assembly of FIG. 4 showing a second view of the support post and the mating housing.

Referring to the convex outer surface of mating housing 40, FIG. 6, there is provided a notched portion defining first and second positioning surfaces 60*b*, 60*a* that are brought into contact with a corresponding first and second engagement surface 56*a*, 56*b*, respectively, formed on the concave inner surface of upper end 21*a*. When tray 12 and seat 14 are configured in the storage position, FIG. 2, first positioning surface 60*b* bears against first engagement surface 56*b* and when tray 12 and seat 14 are configured in the use position, FIG. 1, second positioning surface 60*a* bears against second engagement surface 56*a*.

Referring to FIGS. 5 and 6, release button 30 is positioned between mating housing 40 and tray housing 70 and is biased to extend outwardly from a hole 31 formed in mating housing 40 and one of a corresponding pair of holes 32 and 34 formed in upper end 21*a* when tray 12 is placed in the corresponding use position and storage positions. When release button 30 extends through hole 32, second positioning surface 60*a* bears against second engagement surface 56*a* and locks tray 12 and seat 14 in the use position, FIG. 1. When release button 30 extends through hole 34, first positioning surface 60*b* bears against first engagement surface 56*b* and locks tray 12 and seat 14 in the storage position, FIG. 2. Release button 30 is biased outwardly by placing a compression spring 50 between button 30 and tray housing 70. When configuring from the use to the storage position, button 30 is manually depressed so as to clear button from hole 32. Once clear, tray 12 and seat 14 are then rotated about bolt 42 until button 30 extends through hole 34. When engaged with hole 34, tray 12 and seat 14 are locked in a storage configuration until button 30 is again depressed to clear button 30 from hole 34 to permit rotation of tray 12 and seat 14 into the use position where button 30 extends through hole 32.

Figure 7:
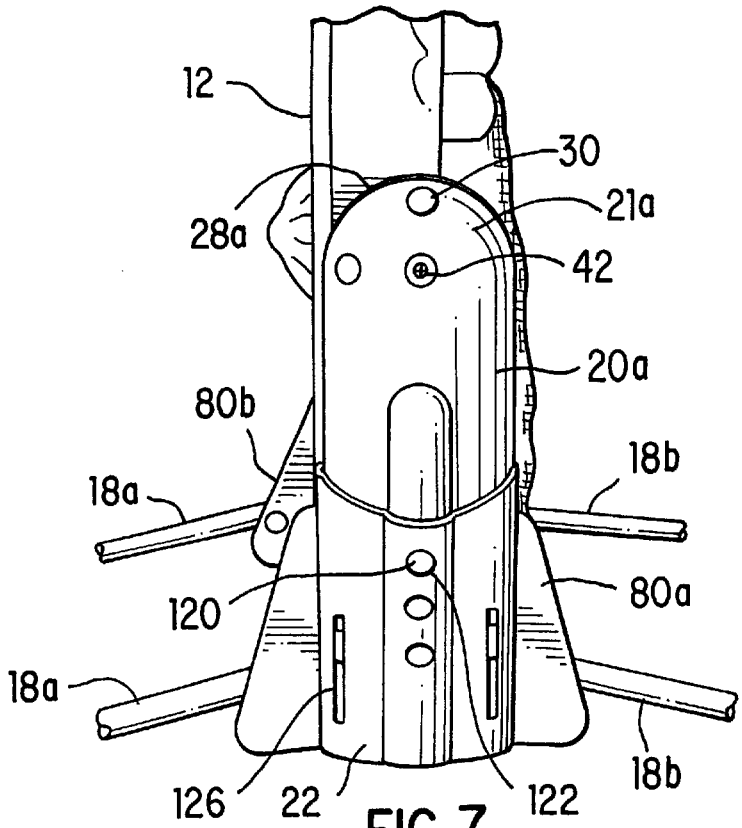
FIG. 7 is a side view of the support post of the activity device of FIG. 1 with a base cover removed.
Figure 8:
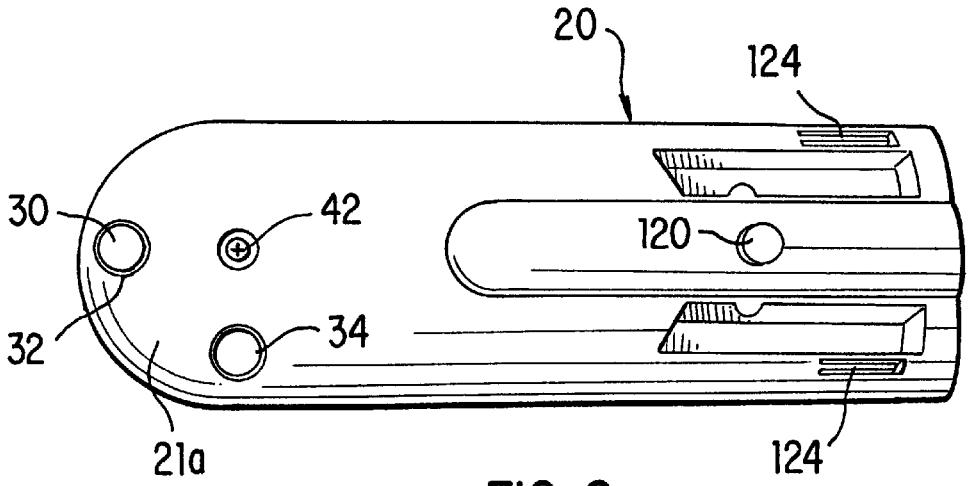
FIG. 8 is a side view of the support post of FIG. 7 with a post cover removed.

Referring to FIGS. 6–8, the height of tray 12 and seat 14 are preferably adjustable by selective vertical positioning of post 20 relative to base 80. Post 20 is fixable at a designated height location by engagement of a spring biased height adjuster button 120 that is mounted in post 20 and extends outwardly through a positioning aperture 122 formed on a base front end 22 corresponding to a pre-designated tray height, as illustrated in FIG. 7 (ribbed base cover removed). Preferably, three positioning apertures are formed on base front end 22 corresponding to three height locations. Post 20 is slidingly coupled to base 80 and releasably fixed at a selected height when height adjuster button 120 is engaged with a corresponding aperture 122. To adjust the height setting, height adjuster button 120 is pressed inwardly so as to clear button 122 from base front end 22. When height adjuster button 120 is depressed, post 20 may freely slide in base 80 until height adjuster button 120 expands into a selected aperture 122, post 20 contacts bottom of base 80, or adjustment stops 124 sliding in grooves 126 contact the top of grooves 126. Height adjuster button 120 is mounted in post 20 by a plate 64 secured to post 20 by fasteners 62, FIG. 6.

Support tubes 16*a*, 16*b*, and base connectors 82, 84 connecting support tubes 16 to bases 80*a*, 80*b* will now be described in detail by reference to FIGS. 9–13. Left and right support tubes 16*a*, 16*b* provide stability to entertainer 10 when in use, a supporting structure for permitting bouncing motion and are coupled to bases 80*a*, 80*b* so as to permit repositioning of tubes 16*a*, 16*b* between use and storage positions. Each of left and right support tubes 16*a*, 16*b* are identical. Tube 16*a* is preferably a U-shaped metal tube with front and rear proximal ends 18a connecting tube 16*a* to front and rear bases 80*a*, 80*b*, respectively, and a rearwardly extending distal end 17*a* including rubber floor grips 24 to reduce undesired slippage of entertainer 10 during use. Tube 16*a* may alternatively be constructed from a plastic or other suitable material. Tube 16*a* may also correspond to a front and rear pair of separate legs or supports extending outwardly from front and rear bases 80*a*, 80*b* since this alternative structure may also provide the same functionality that is considered within the scope of the invention.

Base connectors 82 and 84, disposed at each of the front and rear bases 80*a*, 80*b* are identical in their design and function. Reference will therefore be limited to base connectors 82, 84 of front base 80*a*, except as noted below, with the understanding that the same description applies to base connectors 82, 84 of rear base 80*b*. Referring to FIG. 9, there is illustrated the preferred arrangement of base connectors 82, 84 mounted to base 80a with proximal ends 18*a*, 18*b* of left and right tubes 16*a*, 16*b* connected to base connectors 82, 84, respectively. Each of base connectors 82, 84 are mirror opposites of each other and provide the same function with regard to the various couplings of respective left and right tubes 16*a*, 16*b* to base 80*a*. Base connectors 82, 84 each include a flange coupling 83, 85 for coupling tubes 16*a*, 16*b* to base 80*a* through pivot pins 92, 93 and left and right compression springs 96, 97, respectively.

Figure 11A:
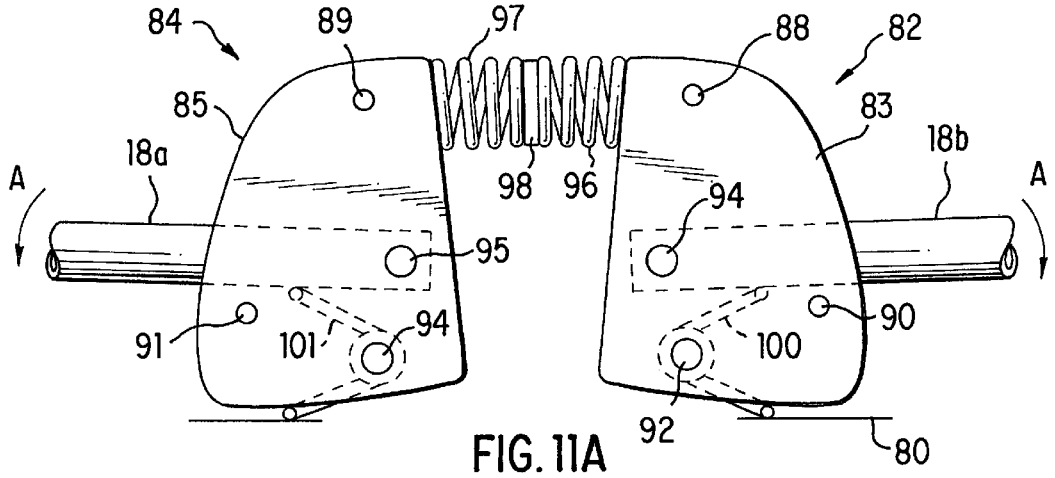
FIG. 11A illustrates a non-use position of the connector assembly of FIG. 9.

Reference will now be limited to right base connector 82 with the understanding that the same description applies to left base connector 84, except as noted otherwise. Referring to FIG. 11D, flange coupling 85 includes front and rear side walls 75*a*, 75*b* extending outwardly from a rear wall 74, a lower lock aperture 91 and an upper lock aperture 89 formed in the front side wall 75*a* for locking tube 16*a* in a use position, FIG. 11B, and storage position, FIG. 9, respectively, a tube pivot hole 76 bored through the front and rear side walls 75*a* , 75*b* for receiving a rivet 95 passed through the end of tube 16*a* to provide a fixed, rotatable coupling between flange 85 and tube 16*a*, and a pivot hole 77 bored through the front and rear side walls 75*a* , 75*b* for receiving pivot pin 93 coupling flange coupling 85 to base 80*a*. Tube 16*a* includes a hole spaced away from the end. The hole (not shown) receives a spring biased button lock 87 disposed within tube 16*a* that is located so as to extend through each of upper and lower apertures 91, 89, when tube 16*a* is positioned in a use position, FIG. 11B, and storage position, FIG. 9, respectively. Preferably, button lock 87 is a spring biased button sold under the trademark "VALCO", which includes a rounded end that biases outwardly from the hole formed in tube 16*a*.

Figure 2:
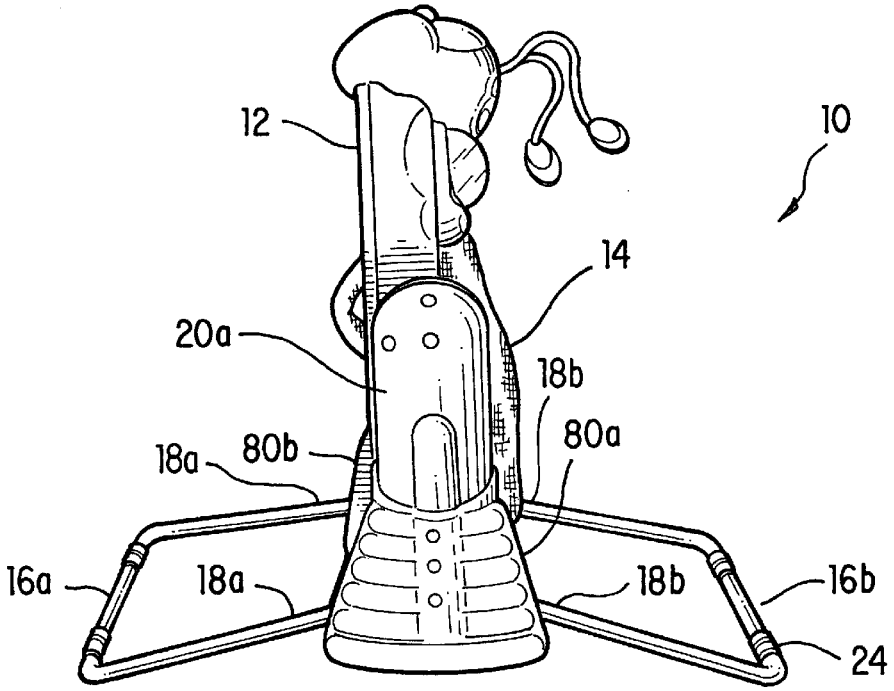
FIG. 2 is a side view of the activity device of FIG. 1 showing a tray and seat configured in a storage position.
Figure 3:
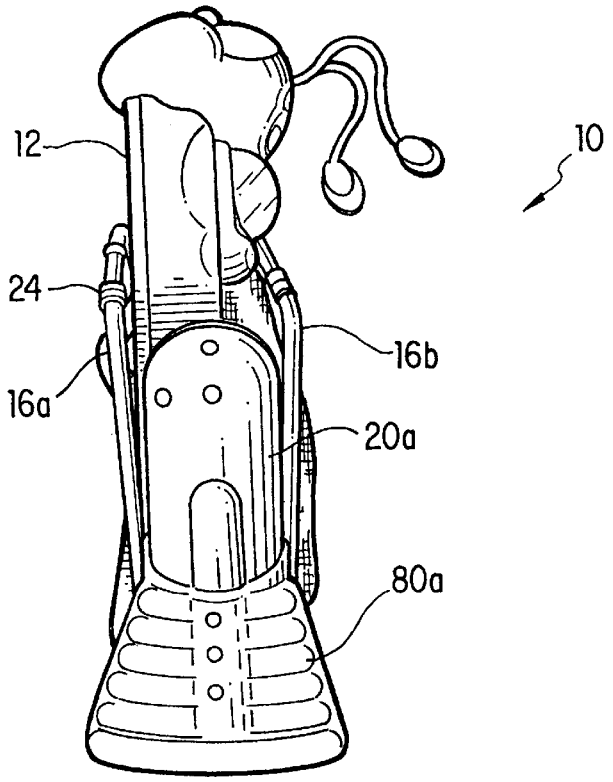
FIG. 3 is a side view of the activity device of FIG. 1 in a storage position.
Figure 10:
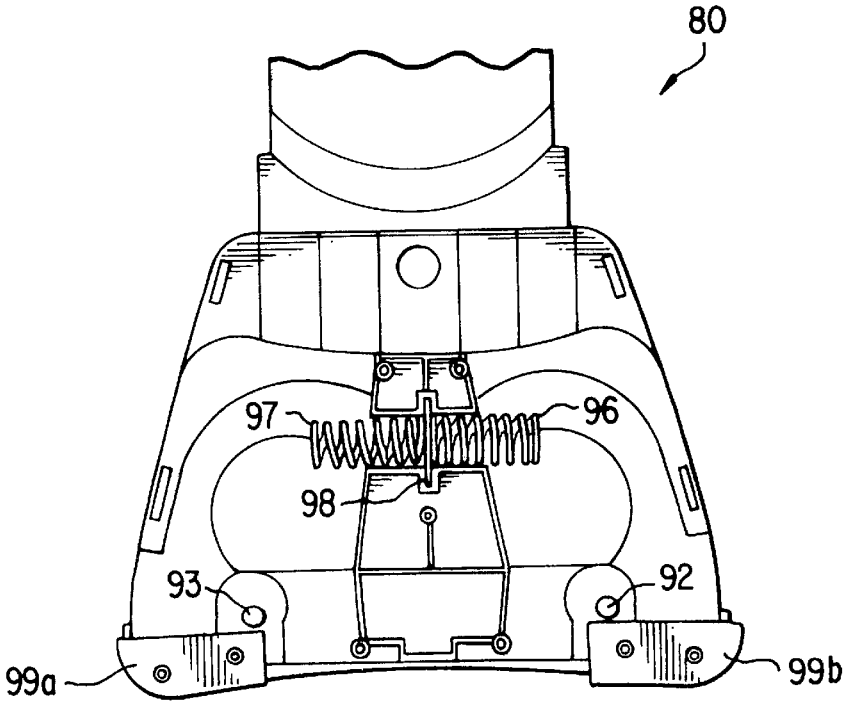
FIG. 10 is a side view of the connector assembly of FIG. 9 with the left and right support tubes and left and right flange couplings removed.
Figure 11B:
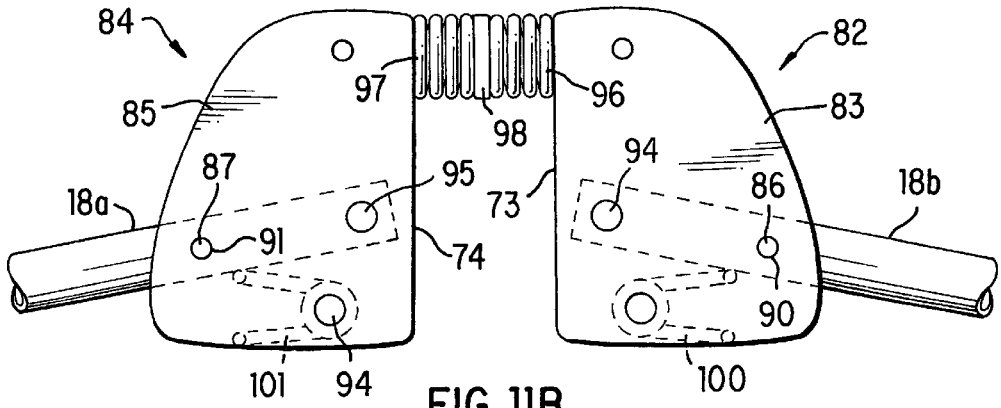
FIGS. 11B–11C illustrate in-use positions of the connector assembly of FIG. 9.
Figure 11C:
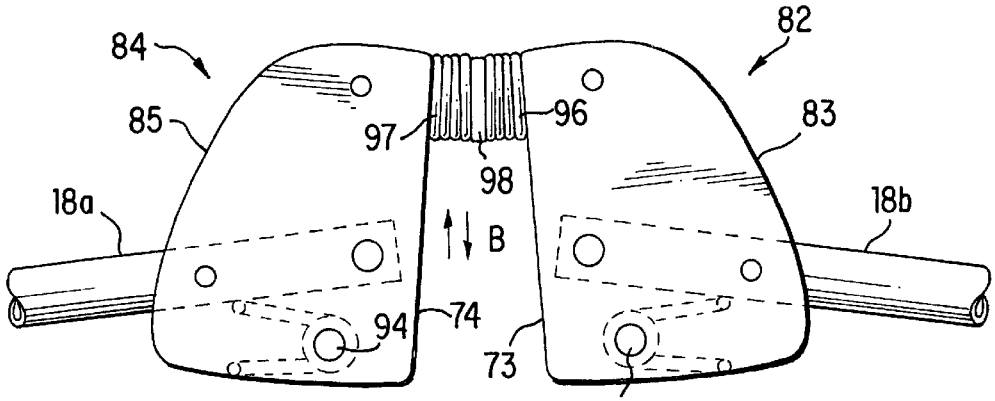
Figure 11D:
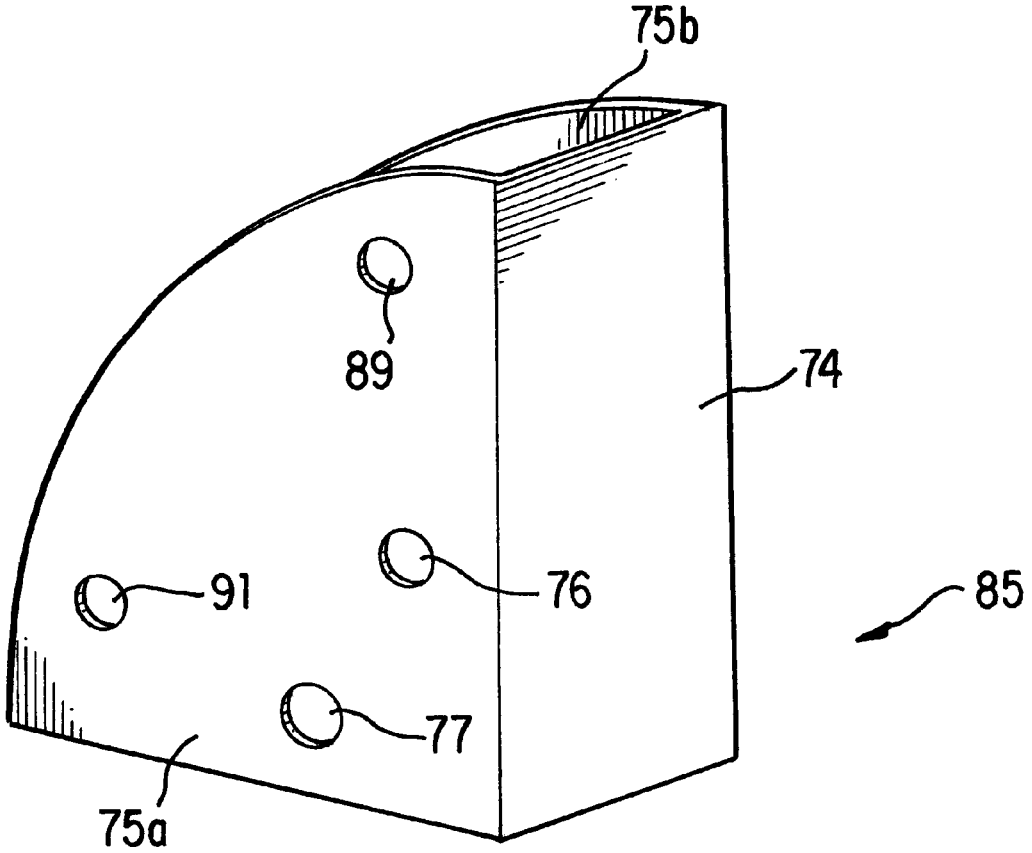
FIG. 11D shows a flange coupling of the connector assembly of FIG. 9.

Referring now to base connectors 82 and 84 with respective proximal ends 18*a*, 18*b* of tubes 16*a*, 16*b* configured in the use position corresponding to button locks 86, 87 extending through lower lock apertures 90,91, FIGS. 1, 2 and 11B, tubes 16*a* and 16*b* are orientated to extend downwardly from base 80*a* so as to suspend base 80*a*, post 20, tray 12 and seat 14 above the support surface. In this configuration, entertainer 10 is supported on tube distal ends 17*a*, 17*b*. Referring to FIGS. 10, 11B–C, flange couplings 83, 85 are coupled to base 80a by pins 92, 93 and springs 96, 97 to provide a bouncing motion of the upper frame portion (i.e., base 80*a*, post 20, tray 12 and seat 14). Springs 96, 97 are positioned to push against respective flange couplings 83, 85 at end walls 73, 74 and a flange plate 98 of base 80*a*. Springs 96, 97 are each offset from pivot pins 93, 92 so as to impart a counterclockwise and clockwise biasing rotation to flange couplings 85 and 83 and tubes 16*a*, 16*b*, respectively, about base 80a to produce a vertical bouncing motion, as illustrated by the arrows B in FIG. 11C. Bumpers 99*a*, 99*b* are attached to the bases 80 to absorb shock when bases 80 touch the floor.

Preferably, a pair of horizontally extending compression springs 96, 97 are offset from pivots 92, 93 to provide bouncing motion. However, other biasing mechanisms may be employed without departing from the scope of invention. Bouncing motion may alternatively be provided by a variety of spring biasing means, provided anywhere between the flange couplings and base, such as torsion springs, extension springs, elastomeric springs, and other spring types which will be familiar to those skilled in the art. Examples include coupling a torsional spring between each of flange couplings 83, 85 and base 80*a*, or a flexible housing such as a rubber member or bendable plastic may be formed in or secured to base 80*a* for coupling flange couplings 83, 85 and tubes 16*a*, 16*b* to base 80*a*. As will be readily understood by the skilled artisan, each of these alternative embodiments are capable of providing a rotational bias between tubes 16*a*, 16*b* and base 80*a* for bouncing motion.

Figure 12:
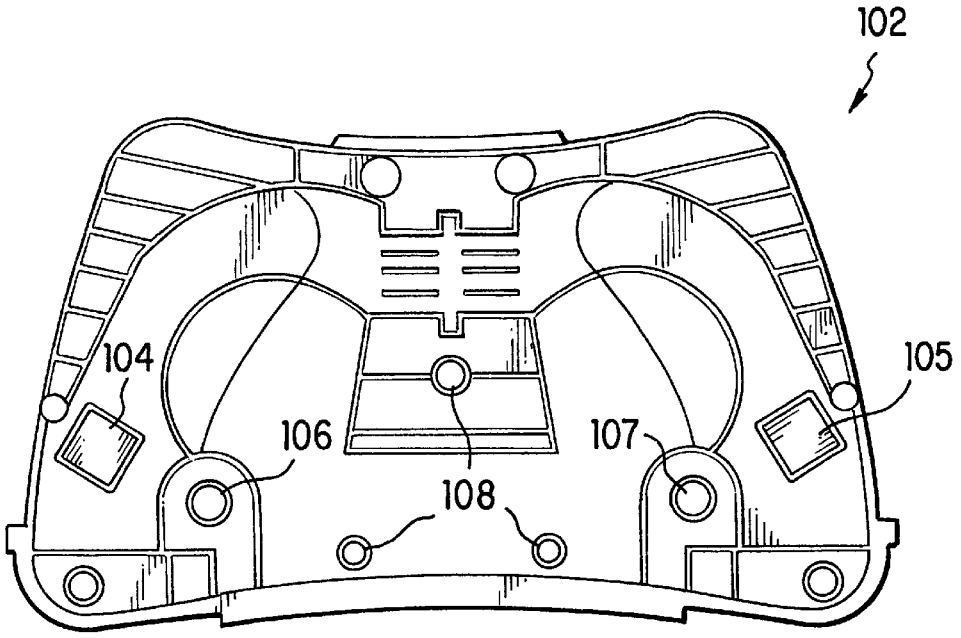
FIG. 12 is a first view of a cover plate of the activity device of FIG. 1.
Figure 13:
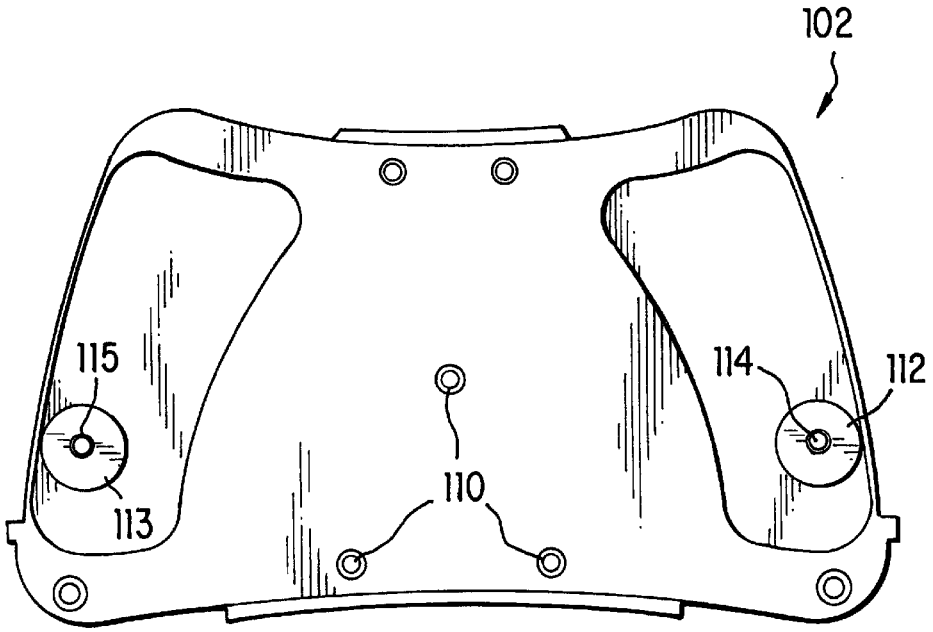
FIG. 13 is a second view of the cover plate of FIG. 12.

Referring to FIGS. 12 and 13, a base cover 102 is used to hold base connectors 82, 84 in base 80*a*. Base cover 102 is secured to base 80*a* by fasteners 110, through holes 108. Base cover 102 includes pivot holders 106, 107 for maintaining pivot pins 92, 93 in proper alignment in base 80*a*. Depressible button releases 112, 113 are mounted on base cover 102 to allow a user to re-position tubes 16*a*, 16*b* from a use position to a storage position. Button releases 112, 113 are attached to contact pads 104, 105 with fasteners 114, 115 and positioned adjacent to lower lock apertures 90, 91 to allow a user to push button locks 86, 87 inwardly so as to clear button locks 86, 87 from lower lock apertures 90, 91. Once clear of lower lock apertures 90, 91, tubes 16*a*, 16*b* may be rotated in relation to their respective flange couplings, 85, 83. Tubes 16*a*, 16*b* are rotatable about pivots 94, 95 when released from lower button lock apertures 90, 91. Upper lock apertures 88, 89 are slightly undersized to cause button locks 86, 87 to only partially extend through lock apertures 88, 89, thereby creating a partial locking condition for tubes 16*a*, 16*b* in the storage position which may be overcome by the user without providing corresponding upper button releases.

Referring to a non-use position of tubes 16*a*, 16*b*, FIG. 11A, a left and right safety spring 101, 100 is preferably positioned against tube proximal ends 18*a*, 18*b* to deter a user from placing a child in entertainer 10 without properly engaging button locks 86, 87 in lower button lock apertures 90, 91. Safety springs 100, 101 are preferably torsional springs disposed between base 80*a* and tube proximal ends 18*b*, 18*a*. Thus, safety springs 100, 101 bias tubes 16*b*, 16*a* away from a use position until a user manually overcomes the spring force to position tubes 16*a*, 16*b* in the downwardly extending, use position (as indicated by arrows A in FIG. 11A), thereby allowing button locks 86, 87 to properly extend through lock apertures 90, 91 to lock tubes 16*a*, 16*b* in the use position.

Figure 14:
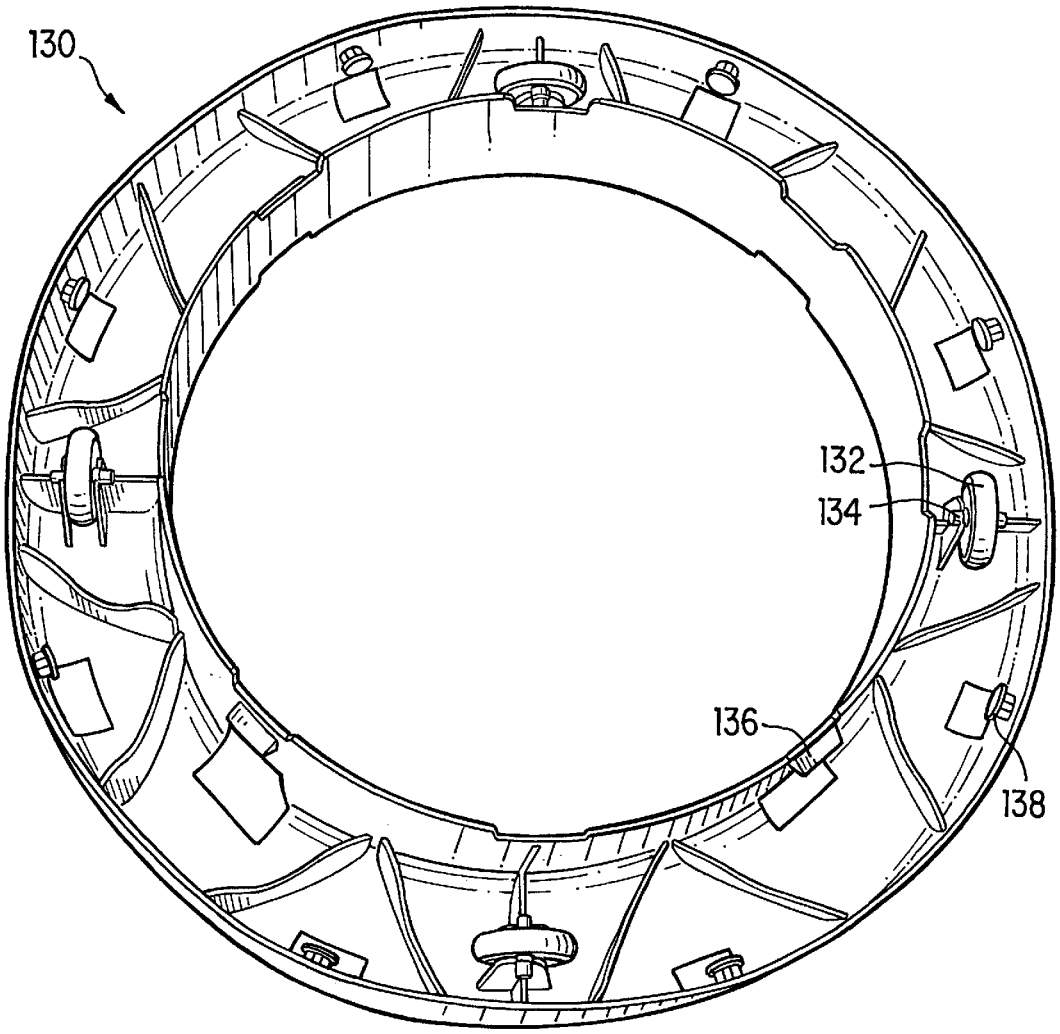
FIG. 14 is a bottom view of a seat ring of the activity device of FIG. 1.
Figure 15:
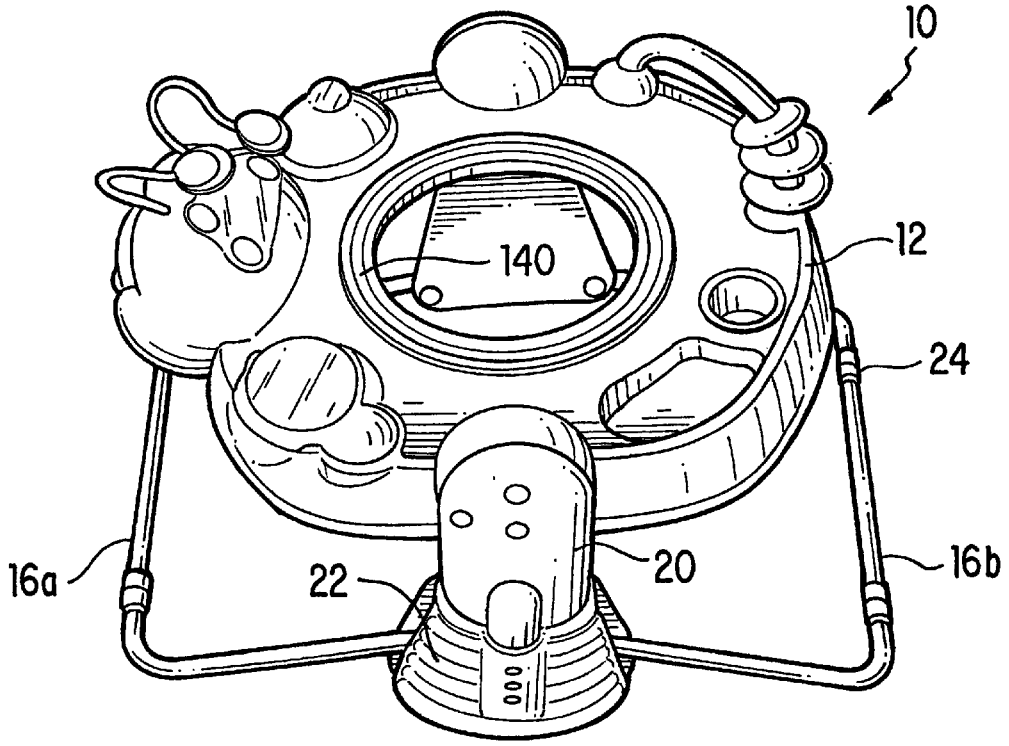
FIG. 15 is a side perspective view of the activity device of FIG. 1 showing the seat removed.

Referring to FIGS. 1, 14–15, seat 14 includes a seat ring 130 attached to a tray race 140 to allow seat 14 to rotate. Seat ring 130 includes wheels 132 attached to axle supports 134 located around the circumference of seat ring 130. A fabric covering 131 is attached to seat ring 130 using hooks 138 located around the outer periphery of the seat ring 130. Seat ring 130 is attached to tray race 140 by placing seat ring 130 over tray race 140 and pushing down on seat ring 130 until locking tabs 136 engage in tray 12. Seat 14 rotates freely around tray race 140, but may be locked in a stationary position using a locking mechanism (not shown).

Entertainer 10 is configurable between a use and storage position as follows. Tray 12 and seat 14 is configured from a use portion, FIG. 1, to a storage position, FIG. 2, by depressing release button 30 located at each of the front and rear tray connectors 28*a*, 28*b* and rotating tray 12 and seat 14 through an angle of approximately 90 degrees from the use position to the storage position, which corresponds to tray 12 and seat 14 extending in a generally vertical orientation. When positioned in the vertical orientation, button 30 will automatically release into hole 34, thereby locking tray 12 and seat 14 in the generally vertical position. Tubes 16*a*, 16*b* may then be configured in their storage position by depressing button lock releases 104, 105 located on each of the front and rear bases 80*a*, 80*b* so as to allow tubes 16*a*, 16*b* to rotate. Tubes 16*a*, 16*b* are then rotated upwards through an angle of approximately 90 degrees until tubes 16*a*, 16*b* partially lock in upper lock apertures. When positioned in the storage configuration, entertainer 10 can then be supported on base 80 and is furthermore self standing, FIG. 3. The position of tube distal ends 17*a*, 17*b* adjacent to tray 12 also provides a convenient hand hold for transporting entertainer 10.

It will be apparent to those skilled in the art that various modifications and variations can be made in the child activity chair of the present invention without departing from the spirit or scope of the invention. Thus, it is intended that the present invention cover the modifications and variations of this invention provided they come within the scope of the appended claims and their equivalents.

What is claimed is:

1. A portable activity center for entertaining a child, said activity center being supportable on a support surface, comprising:

a support frame extending vertically upwards from a lower end proximate to the support surface and terminating at an upper end;

a seat supporting portion;

a seat coupled to said seat supporting portion and being able to rotate about a first axis relative to said support frame so as to allow a child placed in said seat to rotate about said first axis;

a coupling assembly securing said seat supporting portion to said support frame upper end, said coupling assembly being selectable between a closed position fixing said seat supporting portion relative to said support frame and an open position permitting rotation of said seat supporting portion about a second axis substantially perpendicular to said first axis; and a first support leg extending from said support frame lower end and being selectively rotatable about a third axis substantially parallel to said second axis between an extended position and a stowed position, said first support leg including a support surface engaging end and a frame coupling end, a biasing member in contact with said support frame at one end and said frame coupling end at the other end, wherein said biasing member urges said seat upwards by rotation of said first support leg about a fifth axis;

wherein said biasing member is a spring disposed between said support frame and said frame coupling end.

2. The portable activity center of claim 1, wherein said spring is a compression spring extending generally parallel to the support surface.

3. A child's bouncer receivable on a support surface comprising:

a frame having an upper end and a lower end;

a seat coupled to the frame upper end;

a left and right support leg extending outwardly from said frame lower end, each of said left and right support legs including a support surface engaging end and a frame coupling end rotationally displaceable relative to said frame; and a biasing member coupled to each of said left and right support legs and positioned so as to bias each of said left and right support legs upwardly by rotational displacement of said left and right support legs frame coupling ends relative to said frame lower end.

4. The child's bouncer of claim 3, wherein each of said left and right support legs frame coupling ends include an upper end, a lower end offset from said upper end, and said lower end includes a pin for rotationally coupling said frame coupling end to said frame lower end, wherein said biasing member includes a left and right end, the left end being positioned proximate said left support leg coupling end upper end and said right end being positioned proximate said right support leg coupling end upper end.

5. The child's bouncer of claim 4, wherein said biasing member includes a left and right compression spring extending substantially parallel to the support surface, said left spring being positioned between said frame lower end and said upper end of said left support leg frame coupling end and said right spring being positioned between said frame lower end and said upper end of said right support leg frame coupling end.

6. The child's bouncer of claim 3, wherein each of said left and right support legs further comprising an elongate bar having a proximal end and a distal end corresponding to said support surface engaging ends, wherein each of said respective frame coupling ends include a housing connected to said frame lower end by a pivot and said elongate bar proximal ends are connected to said housing at a position offset from said pivot.

7. The child's bouncer of claim 6, wherein said biasing member is positioned on said housing at a position offset from said pivot and said elongate bar connection to said housing.

8. The child's bouncer of claim 3, wherein each of said left and right support legs are U-shaped bars having first and second ends terminating at said respective frame coupling ends and a mid portion extending between said first and second ends and corresponding to said support surface engaging end.

9. A method for configuring a child's activity seat from a deployed position to a folded position, the child's activity seat including a seat coupled to a tray, a base support having an upper end and a lower end and a support frame supporting the activity seat in the deployed position, wherein when the activity seat is configured in the deployed position, a first connector fixes the tray to a base support and a second connector fixes the support frame to the base support, said method of configuring the activity seat from the deployed to folded positions comprising the steps of:

releasing the first connector so as to permit rotational motion of the seat and tray relative to the base support; and rotating the seat and tray about a first axis so as to position the seat and tray from a generally horizontal, deployed position to a generally vertically, folded position.

releasing the second connector so as to permit rotational motion of the support frame relative to the base support; and rotating the support flame about a second axis, substantially parallel to the first axis, so as to position the support frame from a generally horizontal, ground engaging position to a folded, vertical position wherein the support frame is positioned adjacent to the seat and tray.

10. The method of claim 9, further including the step of supporting the folded activity seat in a generally upright orientation on the support surface by placing the base support lower end on the support surface.

11. The method of claim 9, further including the step of forming a bar extending outwardly and having a proximal end rotational coupled to the base support and a distal end outboard from the proximal end, the distal end including a blocking member preventing rotation of the bar relative to the base support, wherein the releasing the second connector step corresponds to the step of clearing the blocking member from the bar so as to permit the bar to rotate about its proximal end relative to the base support.

12. The method of claim 9, wherein said rotating of the support frame includes the step of rotating at least one support leg from a generally horizontal, ground engaging position to a generally vertical position.

13. A foldable activity center for entertaining a child, the activity center being placed on a support surface, comprising:

a base frame extending vertically upwards from a lower end proximate to the support surface and terminating at an upper end;

a supporting portion including a child's seat and an upper surface generally defining an activity area for a child placed in said seat, said upper surface defining a first plane;

a coupling assembly securing said supporting portion to said base upper end, said coupling assembly being selectable between a closed position fixing said supporting portion relative to said base frame and an open position permitting rotation of said supporting portion relative to said base frame, wherein said rotation is within a second plane that is perpendicular to the first plane;

wherein said coupling assembly includes a first and second engagement surface formed on said supporting portion and said frame upper end including a first and second mating surface for engaging said engagement surfaces, wherein said closed position corresponds to one of said first and second engagement surfaces being in mating contact with the corresponding one of said first and second mating surfaces and said open position corresponds to both of said first and second engagement surfaces being clear of said first and second mating surfaces.

14. The foldable activity center of claim 13, wherein when said foldable activity center is disposed in a folded position, said first plane is approximately perpendicular to the support surface.

15. The foldable activity center of claim 13, wherein said base frame comprises at least one post.

16. The foldable activity center of claim 15, wherein said supporting portion is disposed above the support surface by said at least one post.

17. The foldable activity center of claim 13, wherein said first plane is defined by a tray.

18. The foldable activity center of claim 13, wherein said seat is disposed between said first and second engagement surfaces.

19. The foldable activity center of claim 13, wherein said first engagement surface is formed on a circular housing.

20. The foldable activity center of claim 13, wherein said first engagement surface is spaced 180 degrees from said second engagement surface.

21. A foldable activity center for entertaining a child, the activity center being placed on a support surface, comprising:

a base frame extending vertically upwards from a lower end proximate to the support surface and terminating at an upper end;

a supporting portion including a child's seat and an upper surface generally defining an activity area for a child placed in said seat, said upper surface defining a first plane;

a coupling assembly securing said supporting portion to said base upper end, said coupling assembly being selectable between a closed position fixing said supporting portion relative to said base frame and an open position permitting rotation of said supporting portion relative to said base frame, wherein said rotation is within a second plane that is perpendicular to the first plane;

wherein said coupling assembly is configured in an open position, said supporting portion is rotatable between a generally horizontal position appropriate for placing a child in said seat and a stowed position corresponding to said supporting portion disposed in a generally vertical position.

22. The foldable activity center of claim 21, wherein said base frame includes a post.

23. The foldable activity center of claim 21, wherein said supporting portion first plane is defined by a tray.

24. The foldable activity center of claim 23, wherein said coupling assembly couples said tray to said base frame.

25. The foldable activity center of claim 21, wherein said supporting portion being configured from the generally horizontal position to the generally vertical position corresponds to said activity area being rotated approximately 90 degrees.

* * * * *

UNITED STATES PATENT AND TRADEMARK OFFICE

CERTIFICATE OF CORRECTION

PATENT NO. : 6,425,842 B1
DATED : July 30, 2002
INVENTOR(S) : Carl M. Stern et al.

It is certified that error appears in the above-identified patent and that said Letters Patent is hereby corrected as shown below:

Column 10,
Line 31, “flame” should be -- frame --; and

Column 12,
Line 18, “wherein” should be -- wherein when --.

Signed and Sealed this

Seventeenth Day of December, 2002

JAMES E. ROGAN
*Director of the United States Patent and Trademark Office*